US006622440B2

(12) United States Patent
Mercade

(10) Patent No.: US 6,622,440 B2
(45) Date of Patent: Sep. 23, 2003

(54) MODULAR FLOORING

(75) Inventor: Enrique Canela Mercade, Parets Del Valles (ES)

(73) Assignee: Freudenberg Household Products, Weinheim (DE)

( * ) Notice: Subject to any disclaimer, the term of this patent is extended or adjusted under 35 U.S.C. 154(b) by 0 days.

(21) Appl. No.: 09/884,812

(22) Filed: Jun. 19, 2001

(65) Prior Publication Data

US 2002/0124506 A1 Sep. 12, 2002

(30) Foreign Application Priority Data

Jun. 22, 2000 (ES) ..... 200001674 U

(51) Int. Cl.[7] ..... E04F 15/22
(52) U.S. Cl. ..... 52/177; 52/180; 52/581
(58) Field of Search ..... 52/177, 180, 302.3, 52/581, 589.1

(56) References Cited

U.S. PATENT DOCUMENTS 78,263 A * 5/1868 Conner, Jr.
D274,948 S * 7/1984 Swanson ..... D25/91
4,584,221 A * 4/1986 Kung ..... 428/44
5,787,654 A * 8/1998 Drost ..... 52/177
5,992,106 A * 11/1999 Carling et al. ..... 52/177
6,098,354 A * 8/2000 Skandis ..... 52/177

FOREIGN PATENT DOCUMENTS

DE 44 07 231 9/1995

* cited by examiner

*Primary Examiner*—Carl D. Friedman
*Assistant Examiner*—Basil Katcheves
(74) *Attorney, Agent, or Firm*—Leydig, Voit & Mayer, Ltd.

(57) ABSTRACT

Disclosed is a modular floor including a plurality of floor tiles having two sides with different functional characteristics so that one side has a regular checkered surface with protrusions of equal maximum height and on the same plane, comprising areas with open grids and blind areas, while on the other side are some areas with through openings and some with regularly spaced blind openings with protrusions of equal maximum height, all of which coincide with the counterpart of the first side, which are combined with flat sunken areas with respect to the maximum height of this side, which constitute grooves for the insertion of interlocking members and present a surface formed by the closed backs of the blind areas of the first face.

13 Claims, 4 Drawing Sheets

MODULAR FLOORING

DESCRIPTION

This invention refers to a type of modular flooring, specifically one comprised of the association of equally sized floor tiles which have different characteristics of form and function on each of their two sides, with regularly checkered surfaces which allow them to be utilized individually or in combination, that is, the flooring may be constructed with the same side of all the tiles showing or with tiles that show one side combined with others showing the opposite side.

The layouts of floor coverings consisting of the association of a plurality of floor tiles are well known, and such floor coverings may be juxtaposed and connected to each other by practicable means of fitting them together, and present a smooth surface or one equipped with through openings or blind openings over all or part of the area, and are molded from elastomeric or plastic material or made up of an agglomerate textile fiber material.

See utility model no. 252,649 and industrial model numbers 104,183 and 113,831.

The utility model consists of a floor based on molded floor tiles that can have only one side showing, with the side facing down provided with blind holes which reduce the weight and consumption of material, while at the same time lending a springy characteristic to the floor tile, and provide some practicable means of connecting the tiles which consists of complementary male and female parts alternately arranged around all sides of the tile that are visible in the finished floor.

Industrial model no. 104,183 is constructed from molded plastic as in the aforementioned case, having a substantially smooth surface, only one usable side and a practicable means of connection consisting of alternating pegs and holes around the perimeter, which are also visible when the floor is constructed.

Industrial model no. 113,831 consists of a modular element for the formation of floors that may be permeable to liquids, such as those used in the branches of industry dealing with water and chemicals, at swimming pools and at bathing and showering establishments, etc. The elements, molded in plastic, have only one usable side and are provided with a practicable means of connection using a type of fastener that is invisible in the finished floor.

As indicated in the records referred to above, the tiles or elements that constitute the floor, which are not mats in either case, have only one usable side and are attached by male-female connections or by transverse fasteners. In the first case, this results in a connection that is not disguised due to confusion with the drawing of the obverse of the tiles and in the second case it results in a connection that is hidden.

On the other hand, flexible sheets of heavy, elastomeric material also exist, which are preferably rubber, that have their entire surface covered with cylindrical pins of a small diameter. These have a special application in the production of mats, and form a usable, and to some degree comfortable, walking surface. These are somewhat inconvenient due to the fact that between the pins a space is formed in which dust, dry mud and water can accumulate. This results in difficult cleaning, aside from the fact that the free ends of the pins are flat or slightly rounded and do little to eliminate the dust and mud from shoes.

With the goal in mind of avoiding such inconveniences and obtaining greater versatility in floor tiles intended for use in the production of modular and similar floors, without excluding other applications, it would be desirable to produce tiles with two usable sides which could be connected so as to show one or the other of the sides or any combination of them, while at the same time having a means of connection using transverse insertion or male-female parts and relief that is more non-abrasive.

In accordance with the preceding premises the modular floor that is the object of this invention was developed, which consists of the juxtaposition of a plurality of floor tiles having two sides with different functional characteristics so that one side has a regularly checkered surface, with protrusions of equal maximum height and on the same plane, comprising areas with open grids and blind areas, while on the other side are some areas with through openings and some with regularly spaced blind openings with protrusions of equal maximum height, all of which coincide with the counterpart of the first side, which are combined with flat sunken areas with respect to the maximum height of this side, which constitute grooves for the insertion of interlocking members and present a surface formed by the closed backs of the blind areas of the first face.

One characteristic of the invention is that the tiles are provided with a practicable means of connection around the perimeter by mutual transverse insertion of the same in either of the two directions perpendicular to the planes of the tile faces to be joined and/or by mutual coplanar insertion of the same in a horizontal direction in the medial plane of the tiles to be joined.

One preferred implementation of the invention is based on the fact that each tile, preferably quadrangular in shape, is comprised of a medial plane body that, through one of its faces, presents in combination some areas with through openings and extends perpendicularly in some wall areas and in some areas covered with pins, so that the wall areas and the pin areas present a substantial maximum coplanar height, while on the other face some areas with through openings are presented which coincide with the areas with available openings on the other side, some flat areas, coinciding with the backs of some wall areas and pin areas of the other side and some wall areas and some pin areas, both coinciding with part of the wall areas and pin-covered areas of the other side, configuring said flat areas, with respect to the wall areas and pin areas of the same side, some depressions that constitute grooves for the insertion of free surface interlocking members.

Characteristic of the preceding implementation is the fact that the pin-covered areas of each of the sides of the tiles consist of serpentine pathways of constant width, from which emerges, perpendicularly, a line of isolated pins that is flush with the plane of maximum height. These winding paths are parallel and equidistant from each other, connected by crosspieces with the wall areas and flanked by areas with through openings. Furthermore, the wall areas of each of the faces consist of partitions capped with spaced protuberances which are flush with the plane of maximum height leaving passages between them.

Another characteristic of this preferred implementation of the invention is based on the fact that the wall areas are situated between the pin-covered areas, each forming lines parallel to the two opposing sides of the tile.

Similarly, another characteristic of the invention is that the pins consist of substantially slender frusto-conical elastic bodies, whose larger base, emerging from the serpentine pathway, has a diameter equal to the width of said pathway, while its smaller tip extends superiorly in a crown with a straight cruciform section that is flush with the plane of maximum height, and that the wall areas consist of a concave undulating curivilinear wall formed by the diametrical juxtaposition of two series of semicircular arches, linked to each other by their convex parts in a displaced manner in one quadrant, which occlude some of the through openings.

Another characteristic of the invention is based on the fact that the grooves in one of the faces of the tiles, which are of a substantially rectangular configuration, are delimited by singular rectilinear walls that, while defining walls that extend to the other face, are combined with the serpentine pathways of the pin-covered areas and with the walls of the wall areas, cross over some of the through openings and have a height equal to that of the walls of the wall area, without including the crown protuberances.

Finally, another characteristic of the invention is based on the fact that the tiles, in two of the contiguous sides, have regularly distributed rectangular recesses around the perimeter with semicircular bases, while in the other two contiguous sides there are projections capped with a semi-cylindrical nipple, with flanges that correspond to notches in the aforementioned recesses, which are complementary to them and permit a practicable mutual connection.

To facilitate the understanding of the preceding ideas, a preferred implementation of the invention is described below which makes reference to the illustrative drawings that accompany it. In the drawings.

Figure 1:
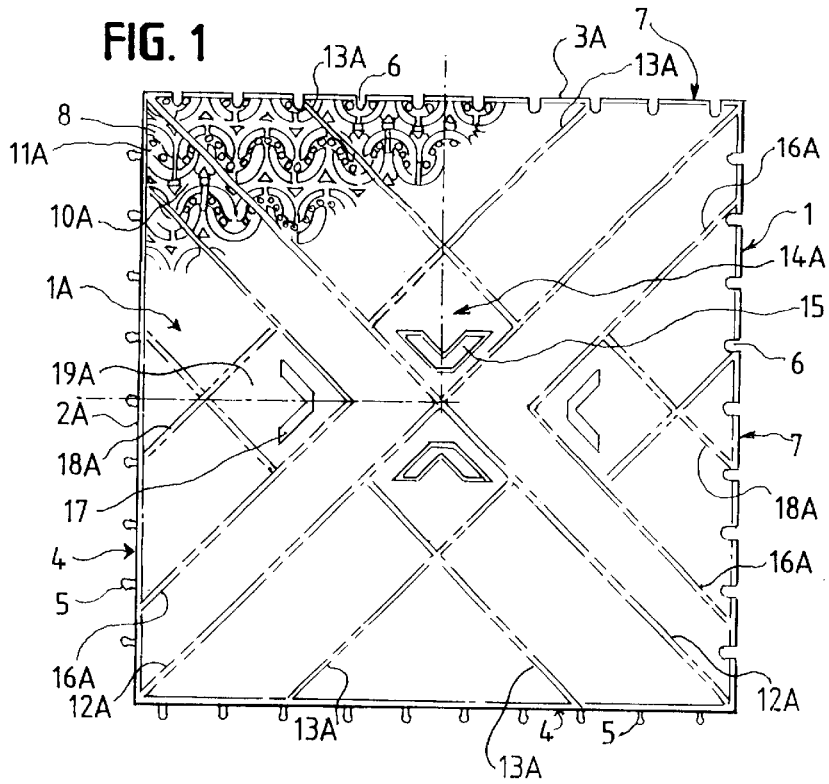
FIG. 1 represents, schematically, one side of a tile floor according to the invention, which is defined as the obverse, which illustrates only one portion of the rough surfaces that characterize it in the upper left quadrant and the characteristic sunken areas of the other face.
Figure 2:
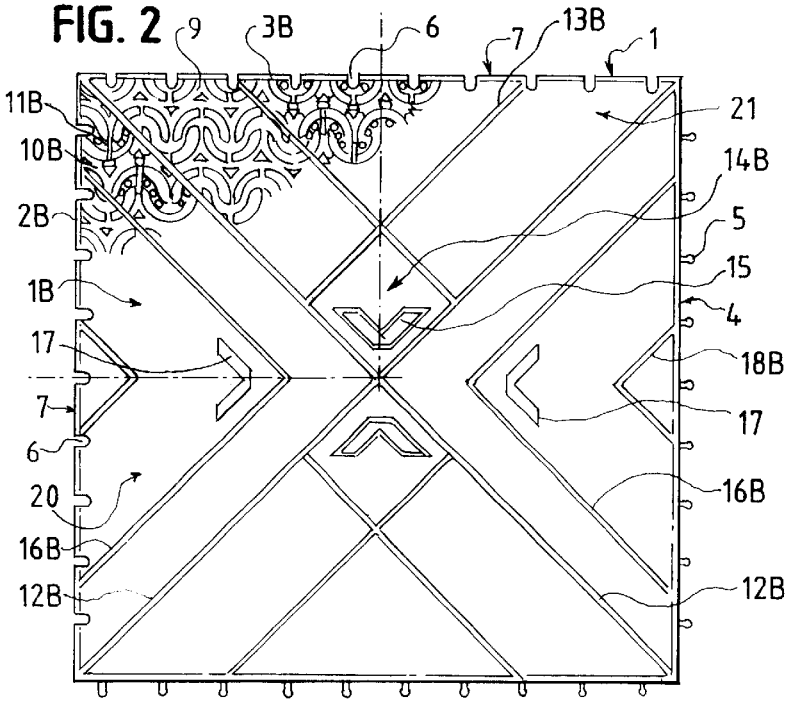
FIG. 2 represents schematically the other face of the floor tile from the previous figure, which is defined as the reverse, which only illustrates one portion of the rough surfaces that characterize it in the upper left quadrant, corresponding to the reverse of the upper right quadrant of FIG. 1.
Figure 3:
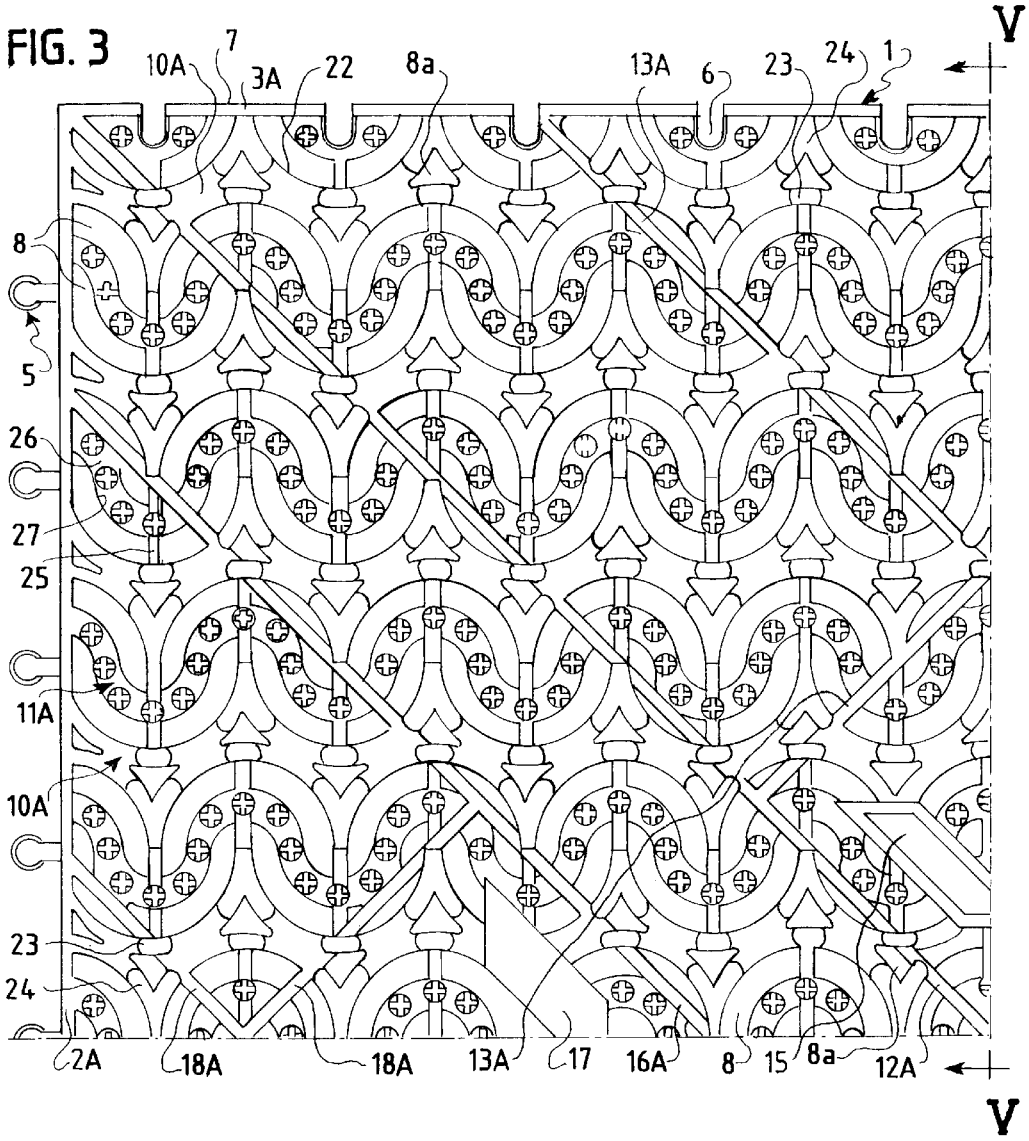
FIG. 3 represents, in detail, the upper left quadrant of FIG. 1.
Figure 4:
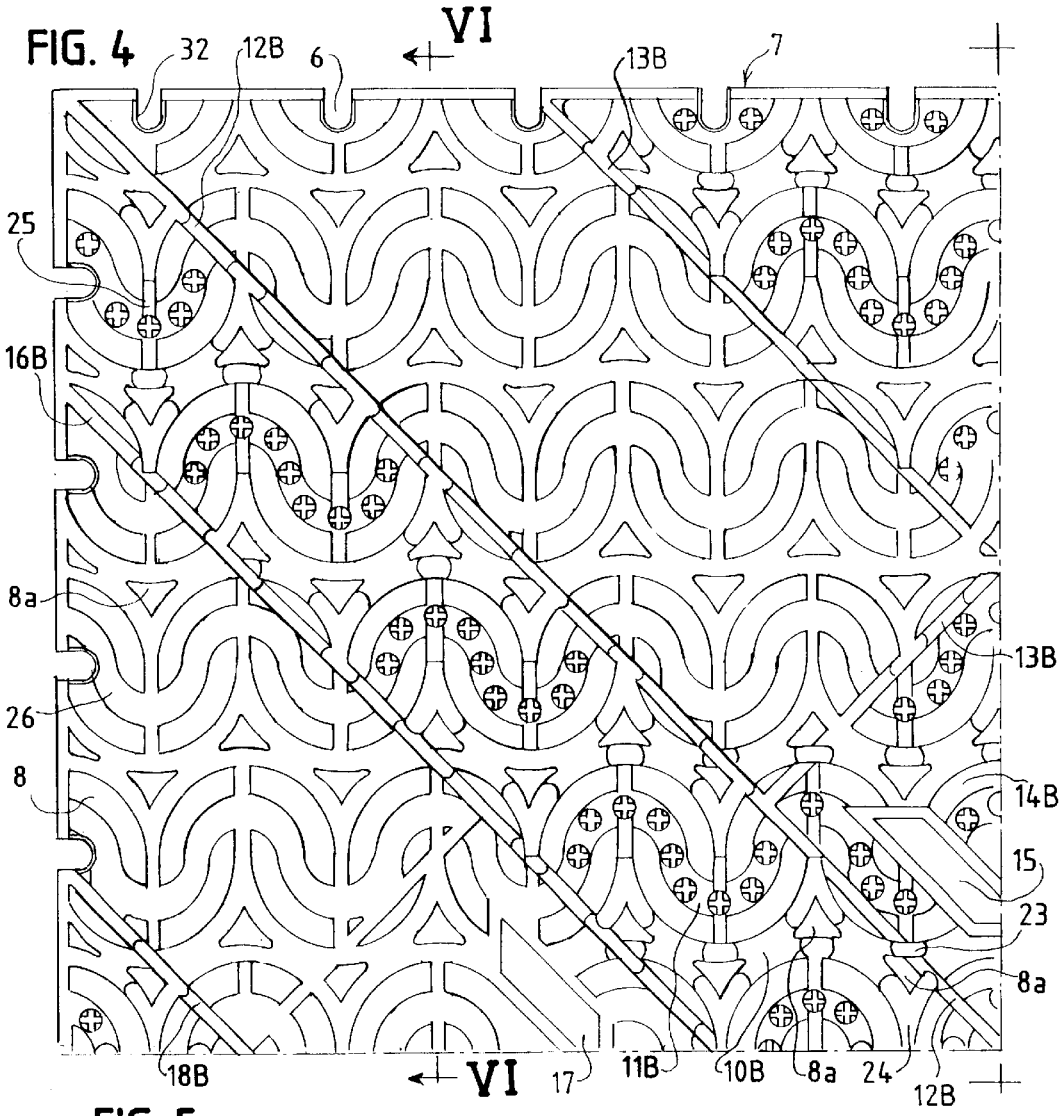
FIG. 4 represents, in detail, the upper left quadrant of FIG. 2.
Figure 5:
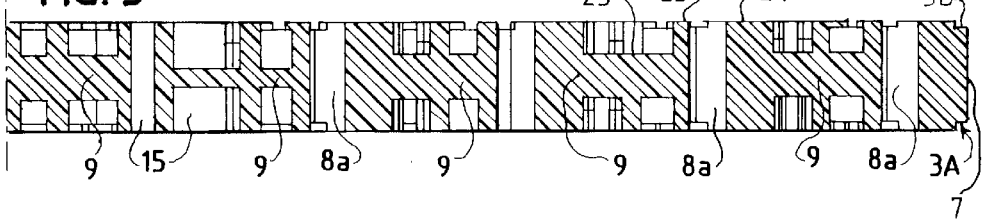
FIG. 5 represents a section through the line V—V of FIG. 1.
Figure 6:
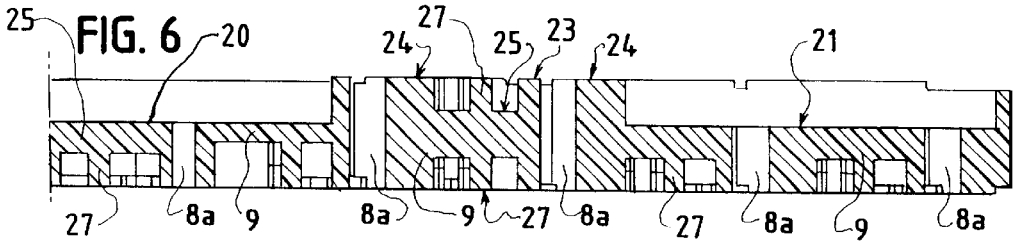
FIG. 6 represents a section through the line VI—VI of FIG. 2.

FIGS. 1 and 2 correspond to the two larger sides of a single tile 1, defined conventionally as the obverse of face 1A of FIG. 1 and as the reverse of FIG. 1B of FIG. 2.

Tile 1, which is preferably quadrangular in form, has continuous steps 2A in the perimeter of its two sides, in correspondence with two contiguous sides, and discontinuous steps 3A, in correspondence with the other two contiguous sides, with respect to face 1A and, similarly, continuous steps 2B and discontinuous steps 3B, with respect to face 1B.

Edge 4 of tile 1, which corresponds to the sides of the same that include continuous steps 2A and 2B, have a plurality of male elements 5 complementary to some recesses 6 in edge 7 that correspond to the sides of tile 1 that include discontinuous steps 3A and 3B.

FIG. 1 shows schematically that the entire surface of face 1A of tile 1, surrounded by continuous steps 2A and discontinuous steps 3A, is essentially checkered by some areas of through openings 8 that, made in a medial plane body 9, are flanked on either side by blind areas supported by said medial plane body 9, which are materialized in some wall areas 10A and in some pin-covered areas 11A. These wall areas 10A and pin areas 11A have a maximum coplanar height and are parallel to said medial coplanar body 9, all of the described areas are parallel to each other, and all those of the same nature are equidistant and parallel to the two opposing sides of tile 1.

In the same FIG. 1, some singular rectilinear walls can be observed which run in the direction of the diagonals and comprise two complete diagonals 12A, two larger sections 13A that cross, starting from two of the opposing sides and reaching complete diagonals 12 to form a square 14A in which is found a through opening marked 15 in an angled "V" shape and with a vertex near the center of the cross of the two complete diagonals 12A, two medium sections 16A which are cut between them to form a right angle in which is included a "V" shaped FIG. 17 and two smaller sections 18A that cross, reaching the medium sections 16A, to form a square 19A that surrounds the aforementioned angled FIG. 17.

Similarly to FIG. 1, FIG. 2 schematically shows that the entire surface of face 1B is compartmentalized by singular rectilinear walls, which extend from their counterparts in face 1A and which are identified with the same basic reference 12, to form the complete diagonals 12B, the large sections 13B, medium sections 16B and smaller sections 18B, which define the grooved areas 20 and 21 in which the through openings 8 appear, flanked by the planar backs of the wall areas 10A and pin areas 11B of face 1A. On the rest of the surface appear wall areas 10B and pin areas 11B, which are the counterparts to those of face 11A of tile 1.

Figure 7:
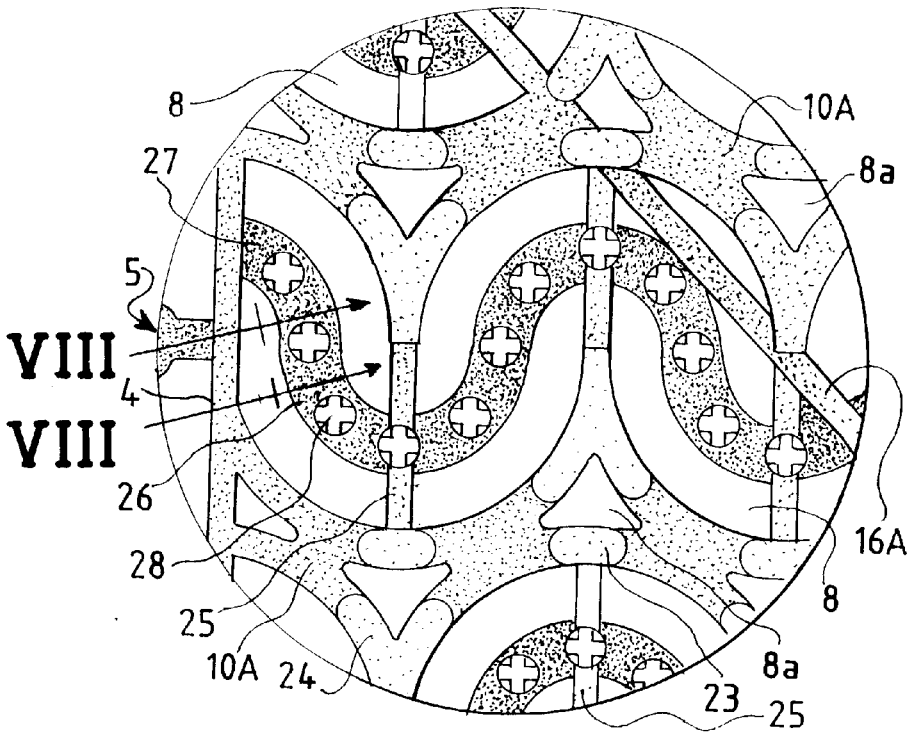
FIG. 7 represents detail VII of the surface of the tile of FIG. 3.

In all cases, face 1A and face 1B, the wall areas 10A and 10B are comprised of, as indicated in FIG. 7, concave undulating curvilinear walls formed by the diametrical juxtaposition of two series of semicircular arches 22 linked to each other by their convex parts in a displaced manner in one quadrant, which occlude some of the small through openings 8*a*. These concave undulating curvilinear walls have oblong 23 and bifurcated 24 crowns with which they reach the maximum coplanar height and are connected to the pin areas 11A and 11B through the crosspieces 25.

Furthermore, in all cases, faces 1A and 1B, the pin areas 11A and 1B are comprised of serpentine pathways 26 of constant width, from which emerge, perpendicularly, a line of equidistant pins 27 that are flush on their free end with the plane of maximum height of the corresponding face.

Figure 8:
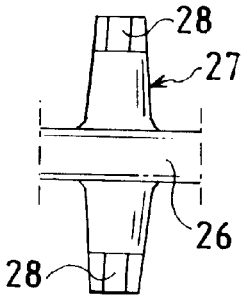
FIG. 8 represents a section along line VIII—VIII of FIG. 7.

The pins 27, as shown in FIG. 8, are comprised of substantially slender frusto-conical elastic bodies whose larger base has a diameter equal to the width of the serpentine pathway 26, while its smaller tip extends superiorly in a cruciform straight crown section 28, which is flush with the plane of maximum height.

Figure 9:
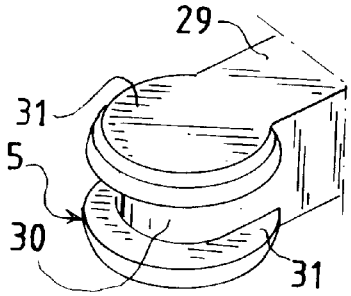
FIG. 9 represents, in perspective, the male element of the practicable means of connection.

The practicable means of connection, as partially detailed in FIG. 9, are comprised of male elements 5, and projections 29 capped transversally with a semi-cylindrical nipple 30, and two circular flanges 31 that correspond to notches 32 in the recesses 6 complementary to them. This arrangement permits connection of both male and female elements, without excluding the possibility of transverse insertion of the same.

What is claimed is:

1. A modular flooring system comprising:

a plurality of interconnectable tiles, each tile including a medial portion, said medial portion including a first side and a second side, said medial portion including at least one through-hole extending between said first and second sides, each tile having a first plurality of protrusions extending from said first side of said medial portion and a second plurality of protrusions extending from said second side of said medial portion, said first plurality of protrusions including at least one first wall surface forming a first boundary which defines a groove region, said second plurality of protrusions including a second wall surface forming a second boundary, said medial portion including at least one blind area bounded by said groove region, whereby said first wall surface and said blind area define a groove.

2. The modular flooring system according to claim 1, wherein said second boundary includes at least a portion of said second plurality of protrusions.

3. The modular flooring system according to claim 1, wherein for each tile, said medial portion defines a medial plane, and each tile comprises a first connecting element and a second connecting element, said first connecting element of one tile and said second connecting element of another tile connectable via movement of said first connecting element of the one tile with respect to the second connecting element of the other tile in a direction perpendicular to said medial planes of the tiles to be joined.

4. The modular flooring system according to claim 3, wherein each tile is quadrangular and has four sides, a plurality of first connecting elements disposed in spaced relation to each other along two contiguous sides of the tile, and a plurality of second connecting elements disposed in spaced relation to each other along the other two contiguous sides of the tile, each of said first connecting elements being a recess with a notch, each of said second connecting elements being a barbed projection.

5. The modular flooring system according to claim 1, wherein for each tile, said medial portion defines a medial plane, and each tile comprises a first connecting element and a second connecting element, said first connecting element of one tile and said second connecting element of another tile connectable via movement of said first connecting element of the one tile with respect to said second connecting element of the other tile in a direction parallel to said medial planes of the tiles to be joined.

6. The modular flooring system according to claim 1, wherein each tile is quadrangular, and at least one of said first and second pluralities of protrusions includes a plurality of pins.

7. The modular flooring system according to claim 1, wherein at least one of said first and second pluralities of protrusions includes a plurality of curvilinear walls.

8.A modular flooring system according to claim 1, including a brush-like member disposed in said groove.

9. The modular flooring system according to claim 6, wherein both said first and second pluralities of protrusions include a plurality of pins.

10. The modular flooring system according to claim 6, wherein said pins define a serpentine pathway on at least one of said first and second sides.

11. The modular flooring system according to claim 6, wherein said pins each comprise a frustoconical portion having a base and a tip, said base being relatively larger than said tip, said base extending from said medial portion, and said tip extending from said base and having a generally cruciform cross-section.

12. The modular flooring system according to claim 7, wherein both said first and second pluralities of protrusions include a plurality of curvilinear walls.

13. The modular flooring system according to claim 7, wherein said curvilinear walls comprise a plurality of alternately juxtaposed semicircular arches.

* * * * *